US012000068B2

(12) United States Patent
Jhunjhunwala

(10) Patent No.: US 12,000,068 B2
(45) **Date of Patent: *Jun. 4, 2024**

(54) WOVEN TEXTILE FABRIC

(71) Applicant: Sachin Jhunjhunwala, Mumbai (IN)

(72) Inventor: Sachin Jhunjhunwala, Mumbai (IN)

( * ) Notice: Subject to any disclaimer, the term of this patent is extended or adjusted under 35 U.S.C. 154(b) by 52 days.

This patent is subject to a terminal disclaimer.

(21) Appl. No.: 17/994,078

(22) Filed: Nov. 25, 2022

(65) Prior Publication Data

US 2024/0076813 A1 Mar. 7, 2024

(51) Int. Cl.

| | |
|---|---|
| ***D03D 15/47*** | (2021.01) |
| ***D03D 1/00*** | (2006.01) |
| ***D03D 15/217*** | (2021.01) |
| ***D03D 15/283*** | (2021.01) |
| *D03D 15/573* | (2021.01) |

(52) U.S. Cl.

CPC ..... *D03D 15/47* (2021.01); *D03D 1/0017* (2013.01); *D03D 15/217* (2021.01); *D03D 15/283* (2021.01); *D03D 15/573* (2021.01); *D10B 2201/02* (2013.01); *D10B 2331/04* (2013.01); *D10B 2401/063* (2013.01); *D10B 2503/06* (2013.01)

(58) Field of Classification Search

CPC .... D03D 15/47; D03D 13/008; D03D 15/225; D03D 15/283; D10B 2201/22; D10B 2331/04

See application file for complete search history.

(56) References Cited

U.S. PATENT DOCUMENTS 10,669,651 B2 * 6/2020 Gupta ..... D03D 15/47
11,225,733 B2 1/2022 Agarwal
2013/0330992 A1 * 12/2013 Mitchell ..... D06P 3/8223 8/652
2019/0186055 A1 * 6/2019 O'Hara ..... D03D 15/217
2020/0056309 A1 * 2/2020 Gupta ..... D03D 15/283

FOREIGN PATENT DOCUMENTS

CN 101956269 A 1/2011
CN 104401057 A 3/2015

OTHER PUBLICATIONS

Aamer Khan, Komal Iftikhar, Danial Saleem & Sajjad Akhtar (2022) Recycled Polyester and Cotton Blended Siro Spun Yarns and Fabrics: A Sustainable and Eco-friendly Approach, Journal of Natural Fibers, 19:16, 13457-13474, DOI: 10.1080/15440478.2022.2095551.

Saini, Neelam, Saroj Kumar Yadav and Neelam M. Rose. "A Comparative Study of Physical Properties of Yarns and Fabrics Produced from Fresh and Recycled Fibres." Current Science (2020): pp. 791-795, DOI: 10.18520/cs/v118/i5/791-795.

* cited by examiner

*Primary Examiner* — Robert H Muromoto, Jr.
(74) *Attorney, Agent, or Firm* — The Roy Gross Law Firm, LLC; Roy Gross

(57) ABSTRACT

A woven textile fabric, the fabric including: a warp yarn with a yarn count of 20 s to 60 s including a blend of a cotton, a recycled cotton and a recycled polyester; and a weft yarn with a yarn count of 20 s to 60 s including a blend of a cotton, a recycled cotton and a recycled polyester, wherein the total content of the recycled cotton in the fabric is at least about 15%, further wherein the fabric exhibits rating of 3 or above when the fabric is tested for pilling after 1000 rubs. The advantageous fabric realized in accordance with embodiments of the present disclosure has excellent wrinkle resistance, high tensile strength, and low pilling.

9 Claims, No Drawings

WOVEN TEXTILE FABRIC

TECHNICAL FIELDS

The present disclosure pertains generally to the field of textile industry. In particular, the present disclosure provides a textile fabric that can find utility as home textile.

BACKGROUND

Background description includes information that may be useful in understanding the present invention. It is not an admission that any of the information provided herein is prior art or relevant to the presently claimed invention, or that any publication specifically or implicitly referenced is prior art.

Often in textile manufacturing, it becomes necessary to scrap products for one reason or another. For example, it could be that the products, once manufactured, did not meet the desired specifications, or perhaps, the product was not as marketable as anticipated. Further textiles used by the consumer are thrown into the landfills have become a big global problem. Apparel made from natural fibers takes years to decompose, whereas man-made fibers do not self-decompose. Woolen clothes do decompose but release methane and carbon dioxide into the atmosphere. This contributes towards global warming. Synthetic fabrics in the landfill release nitrous oxide which is a powerful greenhouse gas. Besides, toxic substances pollute groundwater and surrounding soil.

With increasing demand and problems associated with the decomposition of Apparel, recycling and reusing textiles, fibers, and waste materials is an effective way to build sustainability in the apparel industry. Numerous recycled textile fabrics are reported in the literature, and available in markets that are used by retailers and consumers. However, these recycled textile fabrics are of low quality, non-durable, and exhibit poor elasticity, chemical resistance, tensile strength, pilling, and the like.

There is, therefore, a need in the art to provide a new and improved textile fabric that is comfortable, breathable, exhibits high strength, low piling, and the likes that can find utility as a home textile. The present disclosure satisfies the existing needs, as well as others, and alleviates the shortcomings associated with conventional recycled fabrics.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability.

OBJECTS

An object of the present disclosure is to provide a textile fabric that overcomes the deficiencies associated with the conventional woven textile fabric.

Another object of the present disclosure is to provide a textile fabric that exhibits high tensile strength and good piling resistance.

Another object of the present disclosure is to provide a textile fabric that is durable, wrinkle resistant, and comfortable to human skin.

Another object of the present disclosure is to provide a textile fabric that is economical and easy to manufacture.

SUMMARY

The present disclosure pertains generally to the field of textile industry. In particular, the present disclosure provides a textile fabric that can find utility as home textile.

An aspect of the present disclosure relates to a woven textile fabric, said fabric comprising: a warp yarn with a yarn count of 20 s to 60 s comprising a blend of cotton, recycled cotton and recycled polyester; and a weft yarn with a yarn count of 20 s to 60 s comprising a blend of cotton, recycled cotton and recycled polyester, wherein the total content of the recycled cotton in the fabric is at least about 15%, further wherein said fabric exhibits rating of 3 or above when the fabric is tested for pilling after 1000 rubs.

In some embodiments, the warp yarn comprises: cotton in an amount ranging from about 35 wt. % to about 60 wt. %; recycled cotton in an amount ranging from about 15 wt. % to about 30 wt. %; and recycled polyester in an amount ranging from about 10 wt. % to about 50 wt. %. In some embodiments, the weft yarn comprises: cotton in an amount ranging from about 35 wt. % to about 60 wt. %; recycled cotton in an amount ranging from about 15 wt. % to about 30 wt. %; and recycled polyester in an amount ranging from about 10 wt. % to about 50 wt. %.

In some embodiments, the warp yarn comprises cotton in an amount of about 40 wt. %, recycled cotton in an amount of about 15 wt. % and recycled polyester in an amount of about 45 wt. %. In some embodiments, the weft yarn comprises cotton in an amount of about 40 wt. %, recycled cotton in an amount of about 15 wt. % and recycled polyester in an amount of about 45 wt. %.

In some embodiments, the cotton in the warp yarn and the weft yarn is synthetic cotton, natural cotton or blends thereof. In an embodiment, the warp yarn has 60 to 195 ends per inch (EPI). In some embodiments, the fabric comprises any of: a satin weave, a percale weave and a twill weave. The woven textile fabric of the present disclosure can be used as a bedding product, the bedding product being a bed sheet, a pillow case, a comforter, a coverlet, a pillow sham, a dust ruffle, a blanket, a bedspread, and a duvet cover.

Various objects, features, aspects and advantages of the inventive subject matter will become more apparent from the following detailed description of preferred embodiments, along with the accompanying drawing figures in which like numerals represent like components.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within scope of the present disclosure.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Unless the context requires otherwise, throughout the specification which follows, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The expression "rating of 3 or above" as used herein throughout the present disclosure, in the context of the fabric tested for pilling after 1000 rubs, generally denotes low pilling tendency of the fabric being tested. Specifically, when the pilling tendency of the finished fabric is measured by any of the standard methods ASTM D4970 or ISO 12945-2:2014 and rated on a scale/grade/rating of 1-5, the scale/rating/grade 1 indicates very severe pilling and scale/rating/grade 5 indicates no pilling after the specified number of rubs. The fabric of the present disclosure exhibits the rating of 3 or 4 or 5 after 1000 rubs or cycles, i.e. the woven textile fabric of the present disclosure has low pilling tendency.

The term "woven textile fabric", as used herein throughout the present disclosure, in the context of the fabric being tested for pilling tendency or pilling resistance denotes the dyed, bleached or printed fabric, or otherwise a fabric that is substantially ready for use (e.g. consumer use) without need to be subjected to any further processing that can alter its pilling tendency or pilling resistance. For example, the raw woven fabric may be subjected to dying and/or printing and/or bleaching process(es) to produce the ready to sale (or ready to use) fabric. Such fabric is subjected to the test for measurement of pilling resistance or pilling tendency.

In some embodiments, the numbers expressing quantities of ingredients, properties such as concentration, and so forth, used to describe and claim certain embodiments of the invention are to be understood as being modified in some instances by the term "about." Accordingly, in some embodiments, the numerical parameters set forth in the written description are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable.

The recitation of ranges of values herein is merely intended to serve as a shorthand method of referring individually to each separate value falling within the range. Unless otherwise indicated herein, each individual value is incorporated into the specification as if it were individually recited herein.

The headings and abstract of the invention provided herein are for convenience only and do not interpret the scope or meaning of the embodiments.

Various terms as used herein are shown below. To the extent a term used in a claim is not defined below, it should be given the broadest definition persons in the pertinent art have given that term as reflected in printed publications and issued patents at the time of filing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The present disclosure pertains generally to the field of textile industry. In particular, the present disclosure provides a textile fabric that can find utility as home textile.

The present disclosure is on the premise that when a blend of cotton, recycled cotton and recycled polyester are used in warp and weft yarns to prepare a textile fabric in the weight percentages as defined herein, the textile fabric exhibits excellent wrinkle resistance, high tensile strength, and low pilling. The observed properties are surprising.

An aspect of the present disclosure relates to a woven textile fabric, said fabric comprising: a warp yarn with a yarn count of 20 s to 60 s comprising a blend of cotton, recycled cotton and recycled polyester; and a weft yarn with a yarn count of 20 s to 60 s comprising a blend of cotton, recycled cotton and recycled polyester, wherein the total content of the recycled cotton in the fabric is at least about 15%, further wherein said fabric exhibits rating of 3 or above when the fabric is tested for pilling after 1000 rubs.

While any of the methods as known to or appreciated by a person skilled in the art for testing of pilling resistance can be used, preferred are ASTM D4970 and ISO 12945-2. In an embodiment, the fabric exhibits rating of 3 or above when the fabric is tested for pilling for 1000 rubs in accordance with ASTM D4970. In another embodiment, the fabric exhibits rating of 3 or above when the fabric is tested for pilling for 1000 rubs in accordance with ISO 12945-2:2014. ASTM D4970 and ISO 12945-2 methods make use of a Martindale Tester, wherein the fabric being tested is rubbed face to face for a specified number of rubs/cycles, and the pill balls are evaluated using a photographic visual standard for comparison and given a 1-5 rating, wherein rating/grade 1 indicates very severe pilling and rating/grade 5 indicates no pilling.

In some embodiments, the warp yarn and the weft yarns are spun yarns comprising a blend of cotton, recycled cotton and recycled polyester. Any conventional method for preparing a spun yarn, as known to the skilled artisans, may be used for realizing the spun yarns, having a blend of cotton, recycled cotton and recycled polyester for use in preparing woven fabrics of the present disclosure.

In some embodiments, warp yarn has yarn count of 20 s to 60 s, for example, 20 s to 30 s, 30 s to 40 s, or 40 s to 60 s, preferably, warp yarn has yarn count of 40 s to 60 s. In some embodiments, weft yarn has yarn count of 20 s to 60 s, for example, 20 s to 30 s, 30 s to 40 s, or 40 s to 60 s, preferably, weft yarn has yarn count of 40 s to 60 s.

In an embodiment, total content of the recycled cotton in the fabric is at least about 15%, for example, about 25%, about 40% or about 50% or about 60% or about 70%, preferably, less than about 75%. In an embodiment, total content of the recycled cotton in the fabric ranges from 15% to 70%, for example, from about 15% to about 60%, preferably, from about 15% to about 50%. In some embodiments, total content of the recycled cotton in the fabric ranges from about 15% to about 40% or from about 15% to about 30%.

In some embodiments, the warp yarn comprises: cotton in an amount ranging from about 35 wt. % to about 60 wt. %; recycled cotton in an amount ranging from about 15 wt. % to about 30 wt. %; and recycled polyester in an amount ranging from about 10 wt. % to about 50 wt. %. In some embodiments, the warp yarn comprises: cotton in an amount ranging from about 35 wt. % to about 50 wt. %; recycled cotton in an amount ranging from about 15 wt. % to about 30 wt. %, and recycled polyester in an amount ranging from about 30 wt. % to about 50 wt. %. Preferably, the warp yarn is a spun yarn comprising: cotton in an amount ranging from about 35 wt. % to about 45 wt. %; recycled cotton in an amount ranging from about 15 wt. % to about 20 wt. %; and recycled polyester in an amount ranging from about 40 wt. % to about 50 wt. %.

In some embodiments, the weft yarn comprises: cotton in an amount ranging from about 35 wt. % to about 60 wt. %; recycled cotton in an amount ranging from about 15 wt. % to about 30 wt. %; and recycled polyester in an amount ranging from about 10 wt. % to about 50 wt. %. In some embodiments, the weft yarn comprises: cotton in an amount ranging from about 35 wt. % to about 50 wt. %; recycled cotton in an amount ranging from about 15 wt. % to about 30 wt. %; and recycled polyester in an amount ranging from about 30 wt. % to about 50 wt. %. Preferably, the weft yarn is a spun yarn comprising: cotton in an amount ranging from about 35 wt. % to about 45 wt. %; recycled cotton in an amount ranging from about 15 wt. % to about 20 wt. %; and recycled polyester in an amount ranging from about 35 wt. % to about 50 wt. %.

In some embodiments, the warp yarn comprises: cotton in an amount of about 40 wt. %, recycled cotton in an amount of about 15 wt. % and recycled polyester in an amount of about 45 wt. %. In some embodiments, the warp yarn comprises: cotton in an amount of about 45 wt. %, recycled cotton in an amount of about 20 wt. % and recycled polyester in an amount of about 35 wt. %. In some embodiments, the warp yarn comprises: cotton in an amount of about 35 wt. %, recycled cotton in an amount of about 15 wt. % and recycled polyester in an amount of about 50 wt. %.

In some embodiments, the weft yarn comprises: cotton in an amount of about 40 wt. %, recycled cotton in an amount of about 15 wt. % and recycled polyester in an amount of about 45 wt. %. In some embodiments, the weft yarn comprises: cotton in an amount of about 45 wt. %, recycled cotton in an amount of about 20 wt. % and recycled polyester in an amount of about 35 wt. %. In some embodiments, the weft yarn comprises: cotton in an amount of about 35 wt. %, recycled cotton in an amount of about 15 wt. % and recycled polyester in an amount of about 50 wt. %.

In some embodiments, the cotton in the warp yarn and the weft yarn is synthetic cotton, natural cotton or blends thereof. In some embodiments, the cotton in the warp yarn and the weft yarn is synthetic cotton. In some embodiments, the cotton in the warp yarn and the weft yarn is natural cotton. In some embodiments, the cotton in the warp yarn is synthetic cotton and the cotton in the weft yarn is natural cotton. In some embodiments, the cotton in the warp yarn is natural cotton and the cotton in the weft yarn is synthetic cotton. In some embodiments the cotton in the warp yarn and in the weft yarn is a blend of synthetic cotton and natural cotton.

In some embodiments, the warp yarn has 60 to 195 ends per inch (EPI). In some embodiments, the warp yarn has 60 to 150 ends per inch. Yet in some embodiments, the warp yarn has 60 to 100 ends per inch.

In some embodiments, the weft yarn has 40 to 405 picks per inch (PPI), for example, from 40 to 300, from 40 to 200 or from 40 to 150. In some embodiments, the weft yarn has 40 to 100 picks per inch (PPI).

In some embodiments, the recycled polyester is a polyester spun yarn.

In some embodiments, the fabric has a thread count of 100 to 600 threads per square inch, for example, from 100 to 500 threads per square inch, or from 100 to 400 threads per square inch. In some embodiments, the fabric has a thread count of 100 to 400 threads per square inch.

In an embodiment, the fabric comprises any of: a satin weave, a percale weave and a twill weave. In an embodiment, the fabric comprises of a satin weave. In an embodiment, the fabric comprises of a percale weave. In a preferred embodiment, the fabric comprises of a twill weave.

In some embodiments, the woven textile fabric is used as a bedding product, the bedding product being selected from: a bed sheet, a pillow case, a comforter, a coverlet, a pillow sham, a dust ruffle, a blanket, a bedspread, and a duvet cover. The advantageous fabric realized in accordance with embodiments of the present disclosure can find utility as home textiles.

The woven twill textile fabric, realized in accordance with embodiments of the present disclosure can be made using any apparatus/loom known to a person skilled in the pertinent art. In an embodiment, fabric is prepared by using a pick insertion apparatus such as an air-jet or a Sulzer pick insertion apparatus. However, utilization of any other pick insertion apparatus, as known to or appreciated by a person skilled in the art to serve its intended purpose as laid down in the present disclosure, is completely within the scope of the present disclosure.

Table 1 herein-below provides different types of yarns along with their characteristics used for preparing fabrics.

TABLE 1

Characteristics of yarns

| | | Properties of yarn | |
|---|---|---|---|
| Sr. No. | Yarn | Feel (1-5) | Tensile Strength (1-5) |
| Yarn 1 | Cotton | 5 | 5 |
| Yarn 2 | Recycled cotton | 4 | 2 |
| Yarn 3 | Recycled Polyester | 1 | 3 |
| Yarn 4 | Cotton + Recycled cotton (50% + 50%) | 4 | 3 |
| Yarn 5 | Cotton + Recycled Polyester (50% + 50%) | 2 | 3 |

TABLE 1-continued

| Characteristics of yarns | | | |
|---|---|---|---|
| | | Properties of yarn | |
| Sr. No. | Yarn | Feel (1-5) | Tensile Strength (1-5) |
| Yarn 6 | Recycled cotton + Recycled Polyester (50% + 50%) | 2 | 1 |
| Yarn 7 | Cotton + Recycled cotton + Recycled polyester (40% + 15% + 45%) | 4 | 4 |
| Yarn 8 | Cotton + Recycled cotton + Recycled polyester (45% + 20% + 35%) | 4 | 4 |
| Yarn 9 | Cotton + Recycled cotton + Recycled polyester (35% + 15% + 50%) | 3 | 3 |
| Yarn 10 | Cotton + Recycled cotton + Recycled polyester (30% + 20% + 50%) | 3 | 2.5 |
| Yarn 11 | Cotton + Recycled cotton + Recycled polyester (30% + 15% + 55%) | 2 | 2.5 |
| Yarn 12 | Cotton + Recycled cotton + Recycled polyester (20% + 60% + 20%) | 3 | 2 |

Table 2 below provides characteristics of different fabrics prepared by using different combinations of yarns, provided in Table 1, in the warp and in the weft.

TABLE 2

| Characteristics of woven fabrics | | | | | |
|---|---|---|---|---|---|
| Sr. No. | Warp | Weft | Recycled Cotton content in fabric | Piling (1-5) | Tensile Strength (1-10) |
| 1. | Yarn 1 | Yarn 3 | 0 | 4 | 8 |
| 2. | Yarn 2 | Yarn 3 | 45 | 2 | 3 |
| 3. | Yarn 5 | Yarn 5 | 0 | 4 | 6 |
| 4. | Yarn 4 | Yarn 3 | 30 | 3 | 5 |
| 5. | Yarn 4 | Yarn 5 | 25 | 4 | 6 |
| 6. | Yarn 6 | Yarn 6 | 50 | 1 | 2 |
| 7. | Yarn 7 | Yarn 7 | 15 | 4 | 8 |
| 8. | Yarn 8 | Yarn 8 | 20 | 4 | 9 |
| 9. | Yarn 9 | Yarn 9 | 15 | 3 | 7 |
| 10. | Yarn 10 | Yarn 10 | 20 | 3 | 6 |
| 11. | Yarn 11 | Yarn 11 | 15 | 2 | 5 |
| 12. | Yarn 12 | Yarn 12 | 60 | 2 | 3 |

It could be noted that the fabric realized in accordance with embodiments of the present disclosure i.e. fabric prepared by using spun yarns having a blend of cotton, recycled cotton and recycled polyester as warp and weft is advantageous, in that the resultant fabric is significantly economical.

As can be seen from Table 2, fabric prepared by using spun yarns having a blend of cotton, recycled cotton and recycled polyester as warp and weft yarns retains the economic benefits while having acceptable pilling and tensile strength as compared to a fabric prepared using other yarns (See, Sr. No. 7-12 in comparison to Sr. No. 1-6). Particularly, the fabric obtained (See, Sr. No. 7-9) by using spun yarns having cotton in an amount ranging from 35 wt. % to 60 wt. %, recycled cotton in an amount ranging from 15 wt. % to 30 wt. %; and recycled polyester in an amount ranging from 10 wt. % to 50 wt. % as warp and weft yarns exhibits marked improvement in properties such as pilling and tensile strength as compared to a fabric prepared using other spun yarn blends.

The fabric of the present disclosure exhibits a low tendency of pilling, while achieving the balance between pilling resistance and the tensile strength. Further, the fabric of the present invention is significantly economical owing to usage of recycled cotton and recycled polyester.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

ADVANTAGES

The present disclosure provides a textile fabric that overcomes the deficiencies associated with the conventional woven textile fabric.

The present disclosure provides a textile fabric that exhibits high tensile strength and piling resistance.

The present disclosure provides a textile fabric that is durable, wrinkle resistant, and comfortable to human skin.

The present disclosure provides a textile fabric that is economical and easy to manufacture.

I claim:

1. A woven textile fabric, said fabric comprising:

a warp yarn with a yarn count of 20s to 60s comprising a blend of cotton, recycled cotton and recycled polyester; and a weft yarn with a yarn count of 20s to 60s comprising a blend of cotton, recycled cotton and recycled polyester, wherein the total content of the recycled cotton in the fabric is at least about 15%, further wherein said fabric exhibits rating of 3 or above when the fabric is tested for pilling after 1000 rubs.

2. The fabric as claimed in claim 1, wherein the warp yarn comprises: cotton in an amount ranging from about 35 wt. % to about 60 wt. %; recycled cotton in an amount ranging from about 15 wt. % to about 30 wt. %; and recycled polyester in an amount ranging from about 10 wt. % to about 50 wt. %.

3. The fabric as claimed in claim 1, wherein the weft yarn comprises: cotton in an amount ranging from about 35 wt. % to about 60 wt. %; recycled cotton in an amount ranging from about 15 wt. % to about 30 wt. %; and recycled polyester in an amount ranging from about 10 wt. % to about 50 wt. %.

4. The fabric as claimed in claim 2, wherein the warp yarn comprises cotton in an amount of about 40 wt. %, recycled cotton in an amount of about 15 wt. % and recycled polyester in an amount of about 45 wt. %.

5. The fabric as claimed in claim 3, wherein the weft yarn comprises cotton in an amount of about 40 wt. %, recycled cotton in an amount of about 15 wt. % and recycled polyester in an amount of about 45 wt. %.

6. The fabric as claimed in claim 1, wherein the cotton in the warp and weft yarn is synthetic cotton, natural cotton or blends thereof.

7. The fabric as claimed in claim 1, wherein the warp yarn has 60 to 195 ends per inch.

8. The fabric as claimed in claim 1, wherein the fabric comprises any of: a satin weave, a percale weave and a twill weave.

9. The fabric as claimed in claim 1 for use as a bedding product, wherein the bedding product is selected from the group consisting of a bed sheet, a pillow case, a comforter, a coverlet, a pillow sham, a dust ruffle, a blanket, a bedspread, and a duvet cover.

* * * * *